US008292207B2

(12) United States Patent
Fard et al.

(10) Patent No.: US 8,292,207 B2
(45) Date of Patent: Oct. 23, 2012

(54) METHOD AND APPARATUS FOR THE COARSE AND FINE GRINDING OF MINERAL AND NON-MINERAL MATERIALS

(75) Inventors: Ali Memari Fard, Hameln (DE); Fritz Feige, Roβlau (DE)

(73) Assignees: Petra Memari Fard, Hameln (DE); Nima Memari Fard, Hameln (DE); Ramin Memari Fard, Hameln (DE)

( * ) Notice: Subject to any disclaimer, the term of this patent is extended or adjusted under 35 U.S.C. 154(b) by 41 days.

(21) Appl. No.: 12/679,194

(22) PCT Filed: Sep. 22, 2008

(86) PCT No.: PCT/EP2008/062588

§ 371 (c)(1),
(2), (4) Date: Jul. 29, 2010

(87) PCT Pub. No.: WO2009/037356

PCT Pub. Date: Mar. 26, 2009

(65) Prior Publication Data

US 2010/0301145 A1 Dec. 2, 2010

(30) Foreign Application Priority Data

Sep. 22, 2007 (DE) ..... 10 2007 045 373

(51) Int. Cl.
*B02C 19/00* (2006.01)

(52) U.S. Cl. ..... 241/222; 241/235

(58) Field of Classification Search ..... 241/222, 241/235, 230, 231

See application file for complete search history.

(56) References Cited

U.S. PATENT DOCUMENTS 3,226,042 A 12/1965 Adamski et al.

(Continued)

FOREIGN PATENT DOCUMENTS

DE 1110503 B 7/1961

(Continued)

OTHER PUBLICATIONS

German Search Report (10 2007 045 373.8) dated Aug. 22, 2008, which is enclosed without an English Translation.

(Continued)

*Primary Examiner* — Faye Francis
(74) *Attorney, Agent, or Firm* — Cowan, Liebowitz & Latman, P.C.

(57) ABSTRACT

In the coarse and fine grinding of mineral and non-mineral materials, e.g. limestone, cement clinker, blast-furnace slag, old concrete or ashes, the grinding material, usually including new and recirculated stock, is fed as a defined and laterally bounded material layer (4) of predetermined thickness from a material feed container (3), belonging to the comminuting apparatus, by way of a roller-type or rotary-vane feeder (9), which is arranged at the outlet and can be changed in a stepless manner in respect of its rotational speed, onto the vertex of the laterally rimmed (45), driven, bottom roller (1), accelerated to the roller speed and transported continuously into the gap formed (5) with the upper roller (2), arranged in an offset manner above the driven roller (1), is subjected to hydropneumatic loading using specific compressive forces of 2 to 7.5 kN/mm and is then deagglomerated within the comminuting apparatus by a preferably high-speed rotary crusher (10). This results in good utilization of energy and in low mechanical structural, servicing and maintenance outlay. Usage over a wide spectrum for comminuting different materials is made possible, and linear throughput and speed behavior both in partial-load operation and with high mass throughputs can be realized.

10 Claims, 9 Drawing Sheets

U.S. PATENT DOCUMENTS

| | | | | |
|---|---|---|---|---|
| 4,089,478 | A * | 5/1978 | Collie et al. | 241/167 |
| 4,345,417 | A * | 8/1982 | deBuhr et al. | 56/14.3 |
| 6,116,529 | A * | 9/2000 | Fisher et al. | 241/101.763 |
| 6,517,016 | B1 | 2/2003 | Feige | |

FOREIGN PATENT DOCUMENTS

| | | | |
|---|---|---|---|
| DE | 2830864 | A | 1/1980 |
| DE | 3823929 | A | 2/1989 |
| DE | 19817274 | A1 | 10/1999 |
| FR | 1058697 | A | 3/1954 |
| FR | 1161609 | A | 9/1958 |

OTHER PUBLICATIONS

International Search Report (PCT/EP2008/062588) dated Dec. 23, 2008, which is enclosed with an English Translation.

* cited by examiner

METHOD AND APPARATUS FOR THE COARSE AND FINE GRINDING OF MINERAL AND NON-MINERAL MATERIALS

CROSS-REFERENCE TO RELATED APPLICATIONS

This application is a national stage application of International Application No. PCT/EP2008/062588, filed on Sep. 22, 2008, whose benefit is claimed.

TECHNICAL FIELD

The invention relates to a method for the coarse and fine grinding of mineral and non-mineral materials with the features named in the preamble of claim 1 and an associated apparatus with the features named in the preamble of claim 8.

STATE OF THE ART

The coarse grinding and fine grinding of preferably hard and brittle materials, such as e.g. limestone, cement clinker, slag sand, old concrete or ashes, traditionally takes place in ball mills and more recently increasingly in vertical roller mills and also in high-pressure roller mills.

A high-pressure roller mill called material-bed roll mill is known from DE 27 08 053 B2, in which the comminution of the material takes place by a single compressive-load application between two surfaces at pressures far greater than 50 MPa in the gap of two cylindrical rolls driven in opposite directions.

It is disadvantageous that the high-pressure roller mill operates at very high pressures which are adjustable to only a limited extent and lead to an expensive and very heavy machine design. Moreover, the high-pressure roller mill has an unfavourable throughput-to-speed behaviour. The throughput characteristic line of the high-pressure roller mill is non-linear i.e., depending on the material properties and also on the geometry of the surfaces subjected to load stress, the throughput drops markedly as the circumferential speed increases with a simultaneous increase in the specific energy requirement. High throughputs are therefore possible only by widening the grinding rollers with a proportional increase in the pressing forces, which is, however, limited in mechanical engineering terms.

To improve the procedure as well as the energy utilization of vertical roller mills and also high-pressure roller mills, a process principle was proposed according to EP 1 073 523 B1 according to which the material to be comminuted is prepared as a defined layer on a circulating plate conveyor, channelled horizontally into the gap formed between a roller hydro-pneumatically adjusted onto the material layer and a moving plate conveyor, and subjected to load stress by applying specific pressing forces in the range from 6 to 30 MPa or 600 to 3000 kN/m$^2$. Extensive investigations have shown that, because of technical limits, this process principle and the associated apparatus, called a belt roller mill, cannot replace both the vertical roller mill and the high-pressure roller mill.

Firstly, the application of a load stress to a material layer by applying specific pressing forces in the range of between 600 and 3000 kN/m$^2$ represents an unacceptable limitation.

Secondly, the material channelling of a material layer prepared on a circulating plate conveyor requires a large technical outlay, as the plate conveyor must be also be laid out for the high applications of compressive load stress in the loading zone, whereby to control the wear of both the tension member and the plating and also to limit noise pollution, significant speed and throughput reductions must be accepted.

Thirdly, material channelling using a plate conveyor pulled over the driven, lower roller leads to high losses for reasons associated with mechanical engineering.

Fourthly, the arrangement of a grinding roller hydropneumatically adjusted onto the horizontally guided plate conveyor impairs the material feed, with the result that material can jam and overflow.

A roll press with a drive roll and two offset smaller idling rolls is known from DE 38 23 929 A1. The grinding product drops from the discharge-side end of a conveyor belt into the roll gap formed by the drive roll and the first idling roll.

Alternatively, the grinding product can also be transported into the roll gap by means of a drop tube. The compressed grinding product is subsequently mixed with return product and then conveyed to the second roll gap which is formed from the drive roll and the second idling roll, whereby the product is ground to the desired product fineness. The grinding compression pressures can be set to values of between 50 and 600 MPa.

A roll mill with a fixed roll, a vertically offset clearance roll and a product-feed device is known from DE 28 30 864 A1, wherein the straight line defined by the centres of the two rolls forms an angle of between 35 and 75 degrees to the horizontal. The discharge-side end of the product-feed device is located above the topmost area of the circumference of the lower fixed roll. A slider serves to adjust the height of the product layer which is conveyed to the roll gap. The product-feed device can have at least one movable element which imparts a movement component in the direction of the roll movement to the grinding product, with the result that the grinding product reaches the circumferential speed of the roll more quickly.

DESCRIPTION OF THE INVENTION

An object of the invention is to create a method and the associated apparatus for the coarse and fine grinding of mineral and non-mineral materials, such as e.g. limestone, cement clinker, slag sand, old concrete or ashes, characterized by a high energy utilization and also by a low outlay on mechanical construction, maintenance and upkeep, able to be used in a wide range to comminute different materials and implementing a linear throughput-to-speed behaviour both in partial-load operation and under the conditions of high mass throughputs.

This object is achieved according to the invention in terms of method with the measures according to claim 1 and in terms of apparatus with the measures according to claim 8. Advantageous versions of the invention are given in the dependent claims.

Because the speed of the grinding path of the lower roller is higher than the feed speed of the grinding product, firstly a more homogeneous layer thickness of the grinding product is achieved and secondly material is prevented from accumulating as a result of building up in the area of the discharge-side end of the feed device.

The grinding product, normally consisting of fresh and circulating product, is delivered from a material feed means forming part of the comminution apparatus as a defined and laterally limited material layer with a pre-determined thickness in the area of the vertex of the driven, lower roller provided with lateral rims, is accelerated to the speed of the rollers and conveyed continuously into the gap which is formed with the upper roller arranged offset above the driven roller, subjected to load stress hydro-pneumatically by applying specific pressing forces of 2 to 7.5 kN/mm (force/length of the roll gap) and then deagglomerated by an impact rotor, preferably running quickly, within the comminution apparatus. The deagglomerator can then be dispensed with if the novel comminution apparatus is connected e.g. as a coarse mill combined with a ball mill.

The apparatus consists of two rollers arranged one above the other, of which only the lower roller or both rollers are driven. The upper roller is vertically offset vis-à-vis the lower roller and is hydropneumatically adjusted onto the material-covered surface subjected to load stress of the lower roller. The feed device can already impart a movement component in the direction of rotation of the fixed roll to the grinding product, wherein the speed of the grinding path of the fixed roll is preferably between 3% and 5% higher than the speed of the fed grinding product. The material subjected to load stress which leaves the roller gap agglomerated to a greater or lesser extent is finally conveyed to a deagglomerator connected immediately downstream.

Preferably, the upper roller can be additionally accelerated by its own drive mechanism when the grinding apparatus starts up, or be moved at a different speed from the lower roller during the grinding process, with the result that an additional shearing force is exerted on the grinding product by the relative movement of the two rollers.

Preferably, the upper roller is offset by 60 to 90 degrees, still more preferably by 80 degrees, to the horizontal against the direction of rotation of the lower roller.

Preferably, the material layer is subjected to load stress by applying adjustable specific grinding forces of 2 to 7.5 kN/mm and particularly preferably of 4 to 7 kN/mm (force/length of the roll gap).

Preferably, the material throughput through the roller gap is controlled via a continuous changing of the circumferential speed of the driven roller, maintaining a maximum possible material layer thickness.

Preferably, during the fine grinding, the material portion with over-sized grains is returned to the comminution process, wherein the mass flow of the circulating product is kept constant by adjusting the fresh product conveyed to the grinding process.

Preferably, depending on the material properties and the desired comminution result, the grinding force transmitted with the upper roller can be adjusted in a controlled manner during the grinding process.

Preferably, a mass flow proportional to the circumferential speed of the rollers with an approximately constant layer thickness in the area of the vertex of the lower roller is conveyed in by means of the material feed device.

Preferably, depending on the comminution objective to be achieved, the upper roller is adjusted onto the lower roller with a certain zero gap.

Preferably, the hot gas conveyed into a coarse comminutor for the purpose of coarse comminution and drying of moist feed material is then used as separator air in the separator.

Preferably, the circulating product is conveyed to the roller gap with admixed fresh product.

Preferably, the mass flow of the circulating product is measured via a throughput measuring device integrated in a bucket conveyor.

Preferably, the thickness of the material layer is continuously measured and displayed during operation before it is subjected to load stress in the roller gap.

In a preferred embodiment, the material feed device comprises a roll or star wheel feeder which is attached to the outlet and the rotational speed of which can be altered continuously.

Preferably, the ratio of the diameter of the driven, lower roller to that of the upper roller is 1.0 to 2.0 and particularly preferably 1.0 to 1.5.

Preferably, to generate the grinding force, the lower roller is connected to at least one hydraulic cylinder via a system of levers.

Preferably, the material feed and discharge apparatus arranged in the area of the vertex above the lower roller consists of a filling level-controlled material feed container with a rotating feed device attached to the material outlet, for example a roll feeder.

Preferably, replaceable rims are attached to both sides at the ends of the lower roller to laterally limit the material layer. The rims can be segmented.

Preferably, the surfaces subjected to load stress of the rollers are designed wear-protected and structured by deposit welding or mechanical working.

Preferably, the driven lower roller is housed in bearing boxes and arranged horizontally displaceable together with the end-side casing part.

Preferably, the roll feeder is housed spring-loaded in a height-adjustable rocker to adjust the layer thickness of the material layer.

Preferably, a star wheel feeder, the rotational speed of which can be adjusted continuously and to the material outlet side of which a pre-bunker with a layer thickness adjuster is attached, is connected downstream of the material feed container.

Preferably, to avoid caking and clogging, one or more cantilevered clearing screws are arranged side by side above the inclined discharge wall of the material feed container combined with a roll feeder.

The drive mechanism of the upper roller serves to accelerate the start-up of the roll mill, in particular in the case of large and heavy installations. However, it is thereby also possible to allow the pressure roll to run more slowly in a targeted manner than the fixed roll during the grinding process, whereby the grinding product also experiences a horizontal shearing pressure component in addition to the vertical roll pressure.

The solution according to the invention which realizes these features has a number of further advantages compared with the known high-pressure roller mill and belt roller mill. The advantages of the novel comminution apparatus, called beta roller mill, in process engineering terms are that specific grinding forces up to 7.5 kN/mm can be set as desired depending on both the material and the comminution objective to be achieved and the comminution result can be kept constant and defined irrespective of the roller speed by the parameters of the specific grinding force and the material layer thickness. It has proved to be advantageous, in particular when fine grinding hard and brittle materials such as e.g. cement clinkers and slag sands, to apply the load stress using high specific grinding forces whenever a particularly high-quality finished product is to be produced in a loop with a separator profitably with the lowest possible number of rotations.

In mechanical engineering terms, the advantages of the comminution apparatus according to the invention compared with the comminution apparatus known from EP 1 073 523 B1 are that the technical outlay can be decisively reduced through the absence of the circulating plate conveyor, transferring not only the material feed, but also the preparation of the material layer and its conveyance onto the surface subjected to load stress of the driven, lower roller, an improvement by a factor of 1.3 to 1.4 in the energy utilization during the comminution is shown to be achieved by reducing the mechanical engineering losses, expressed by the size of the idling torque, and thus the limitations with regard to both the specific grinding forces to be applied and the speeds of the grinding path can be removed. Depending on the grindability of the material and the comminution objective to be achieved, specific grinding forces of up to 7.5 kN/mm can be applied when the linear throughput-to-speed behaviour is fully exploited up to speeds of the grinding path of 3 m/s and more. In turn, it follows from this that, through its excellent suitability for high speeds of the grinding path, the comminution apparatus according to the invention is suitable for high throughputs, relatively small and above all much lighter compared with high-pressure roller mills and belt roller mills. In addition, the absence of the circulating plate conveyor and the tension member subjected to a high load stress, limits the wear of the novel comminution apparatus to the surfaces subjected to load stress of two horizontally housed rollers arranged one above the other, whereby not only is the outlay on maintenance and upkeep reduced, but the availability of the apparatus is also substantially improved.

The apparatus according to the invention can process soft materials at a throughput of up to 500 t/h and hard materials at a throughput of up to 130 t/h.

BRIEF DESCRIPTION OF THE DRAWINGS

The invention is explained in more detail with the help of embodiment examples. In the associated drawings, there are shown in.

WAYS OF CARRYING OUT THE INVENTION

Figure 1:
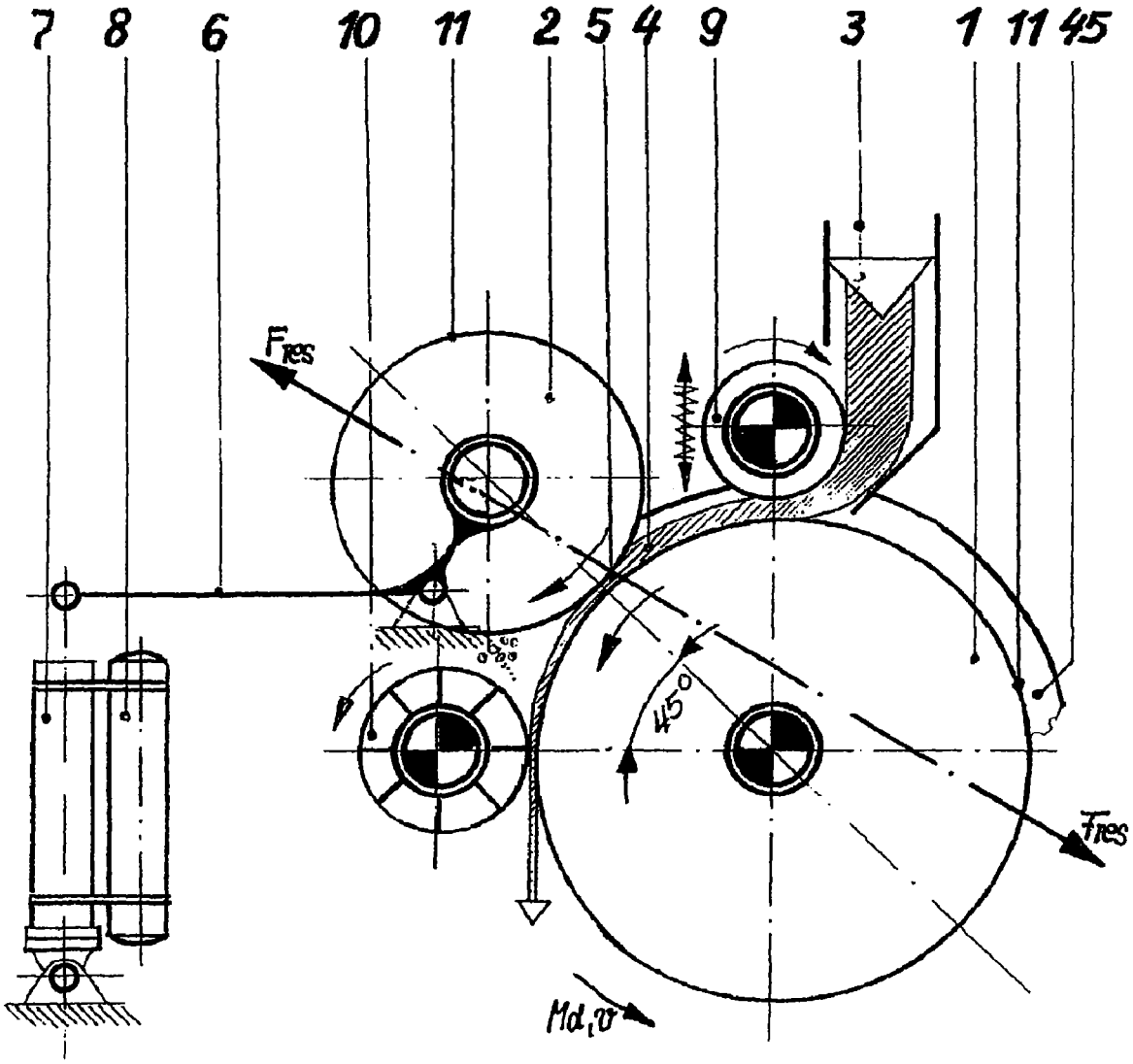
FIG. 1: the apparatus according to the invention in a schematic representation.

FIG. 1 shows, in a schematic representation, the comminution apparatus according to the invention, consisting of two horizontally housed rollers 1 and 2 arranged offset one above the other, an integrated deagglomerator 10 and also a material feed and discharge apparatus consisting of a material feed container 3 and a roll feeder 9. The lower roller 1 is driven in the direction shown by the arrow in FIG. 1. The roller 2 is arranged above the driven roller 1 and vertically offset vis-à-vis the roller 1. The upper roller 2 is hydropneumatically adjusted against the roller 1 via a system of levers 6 by means of a hydraulic cylinder 7. The upper roller 2 is pulled with frictional force by the material-covered surface subjected to load stress of the driven roller 1 or can have a drive mechanism of its own. The ratio of the diameter of the lower roller 1 to that of the upper roller 2 is preferably 1.0 to 2.0 and particularly preferably 1.0 to 1.5.

The material feed and discharge apparatus is arranged in the area of the vertex of the driven lower roller 1. The grinding product, which is in a filling level-controlled container 3, reaches the surface subjected to load stress 11, bordered laterally by screwed-on rims 45, of the driven roller 1 as a defined material layer 4 with a predetermined thickness, in order to be accelerated to circumferential speed and continuously conveyed into the load or roller gap 5 formed by both rollers 1 and 2. A variable-speed roll feeder 9 downstream of the material feed container 3, via the oscillating bearing of which any desired material layer thickness can be set, sees to it that a speed-proportional mass flow which has an approximately constant layer thickness is conveyed to the load or roller gap 5 at any time. An impact rotor, the bearings of which are preferably positioned on the extended horizontal centre line of the lower roller 1, is used as deagglomerator 10, wherein it must be noted that a deagglomerator is not necessary for all comminution objectives. Depending on the size of the comminution apparatus, one or two hydraulic cylinders 7 are used to which the nitrogen containers 8 for the purpose of system damping are also directly attached.

Figure 2:
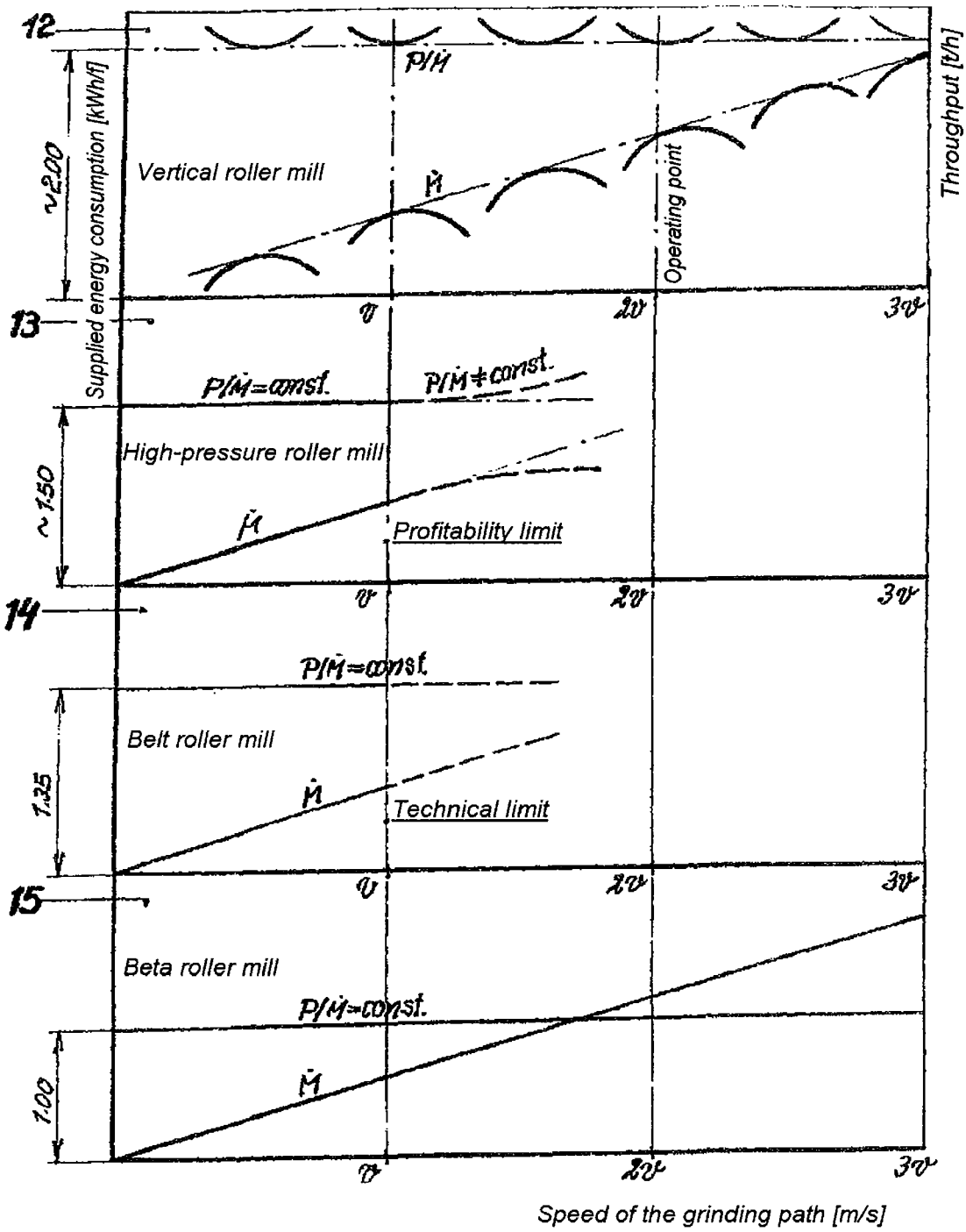
FIG. 2: a comparison of the throughput, performance and speed behaviour of a vertical roller mill, high-pressure roller mill, belt roller mill and beta roller mill.

In a diagrammatic representation, FIG. 2 compares the development of the throughput and specific energy requirement of a vertical roller mill 12, high-pressure roller mill 13, belt roller mill 14 and the beta roller mill 15 according to the invention in relation to the speed of the grinding path. While a vertical roller mill 12, depending on the diameter of the milling disk and the geometry of its milling tools, provides the maximum throughput at the best possible energy utilization selectively, i.e. only at a single operating point and only at a quite specific speed, in the case of the other mills the speed of the grinding path is also available in principle as a parameter for changing the throughput.

The speed-proportional changing of the throughput is, however, limited in the case of the high-pressure roller mill 13 and belt roller mill 14. Because of the complicated ratios of forces arising from the use of a filling level-controlled material overflow, the high-pressure roller mill 13 adopts a throughput-to-speed behaviour that decreases to a greater or lesser extent already from roller speeds of 1.0 m/s, depending on the structuring of the surfaces subjected to load stress and the material to be subjected to load stress. As this behaviour is simultaneously associated with a progressive increase in the specific energy requirement, in the case of the high-pressure roller mill 13 the circumferential speeds are limited to 1.0 to 1.5 m/s for purely economic reasons.

For essentially technical reasons, however, the belt roller mill 14 also cannot be operated in a wide range of speeds. Primarily for reasons relating to wear, but also for reasons relating to noise pollution, both the flat-link chains used as tension member and the plate conveyor itself can no longer be controlled technically at speeds greater than 1.0 m/s because they are also subjected to load stress for system-inherent reasons.

The comminution apparatus according to the invention, called beta roller mill 15, which dispenses with the use of a pulled, continuous plate conveyor and, with the aid of a corresponding feed and discharge apparatus, feeds the material in the area of the vertex of the driven, lower roller 1 can, on the other hand, be operated, both from the technical and from the economic point of view, given a direct proportionality of roller circumferential speed and throughput, in a wide range of speeds up to circumferential speeds of 3.0 m/s and more. With a specific energy use, demonstrated in extensive investigations, which is approx. 50% lower than in the case of the vertical roller mill 12, the beta roller mill 15 is capable, because of its low mechanical losses, of further improving even the energy utilization, already to be described as good, of the belt roller mill 15 by a factor of 1.35.

Figure 3:
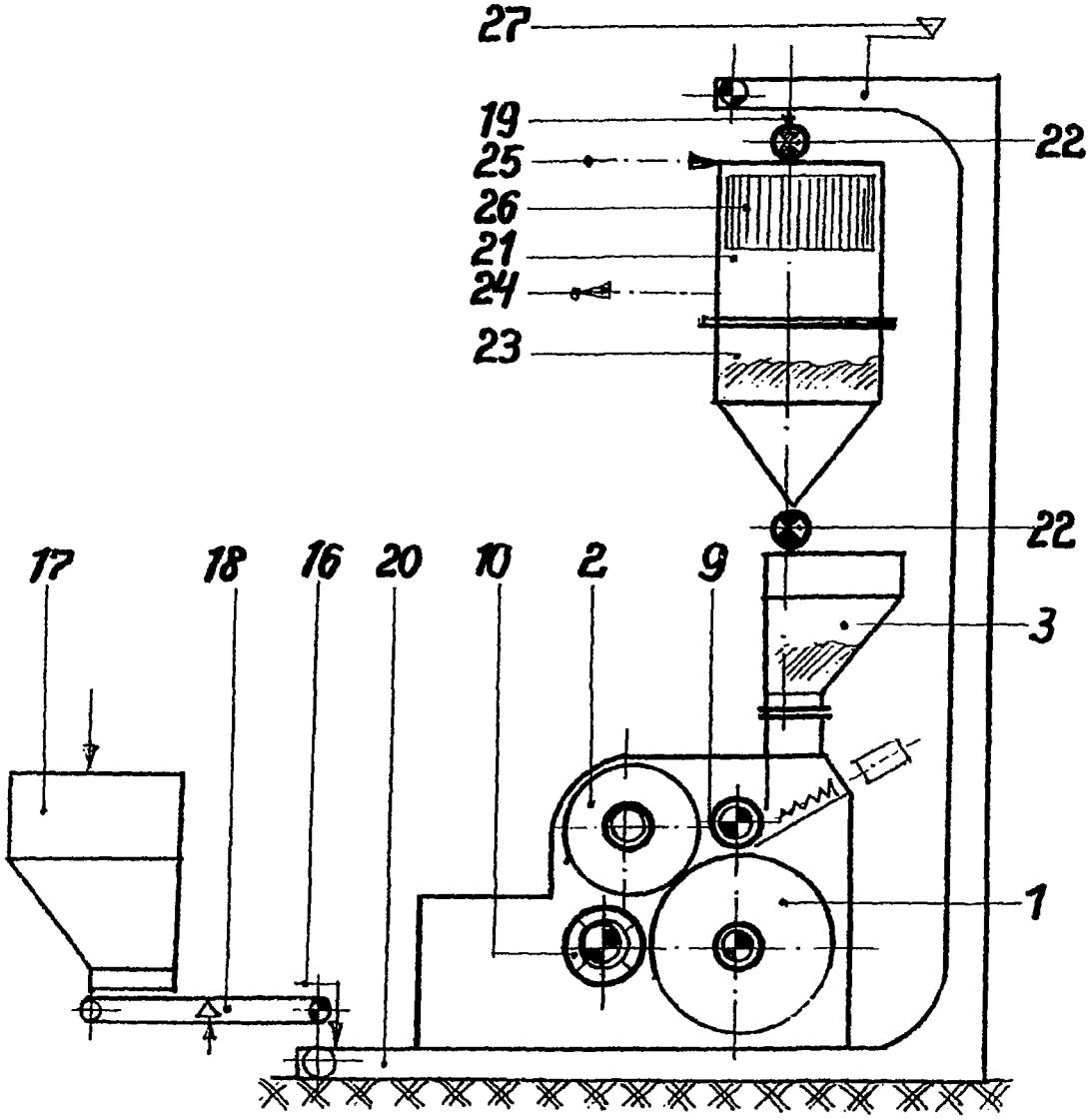
FIG. 3: the apparatus according to the invention connected in a loop with a high-performance separator.

FIG. 3 shows a looped grinding installation with a beta roller mill in the flowsheet, as could be used for instance for cement grinding or for grinding a comparable product. As the drawing shows, both the deagglomerator 10 and the material feed and discharge apparatus, consisting of a filling level-controlled feed container 3 and a variable-speed roll feeder 9, are fully integrated into the comminution apparatus. The fresh product 16, represented in the drawing for only one material component, is removed from a dosing bunker 17 by a dosing belt weigher 18 and, for the better mixing of fresh product 16 with the circulating product 19, fed behind the comminution apparatus to a bucket conveyor 20 which is preferably U-shaped and conveys the cycled material directly to a separator 21, preferably a high-performance separator, while dispensing with further conveyance devices. The separator 21, sealed off in terms of ventilation by cellular wheel sluices 22, has an extended cylindrical separating chamber 23, via the controlled material level indicator of which the material feed container 3 in front of the mill is provided with sufficient material at all times. The separator 21 preferably deposits the finished product contained in the emerging separator air 24 directly in a fabric separator which is not represented in more detail in the drawing. The grinding installation is adjusted to maintain a constant circulating mass flow, wherein the quality of the finished product is changed by adjusting the specific quantity of separator air 25 and via the rotational speed of a separator basket 26 arranged in the separator 21. The circulating mass flow is measured continuously via a throughput measuring device 27 integrated in the bucket conveyor 20.

Figure 4:
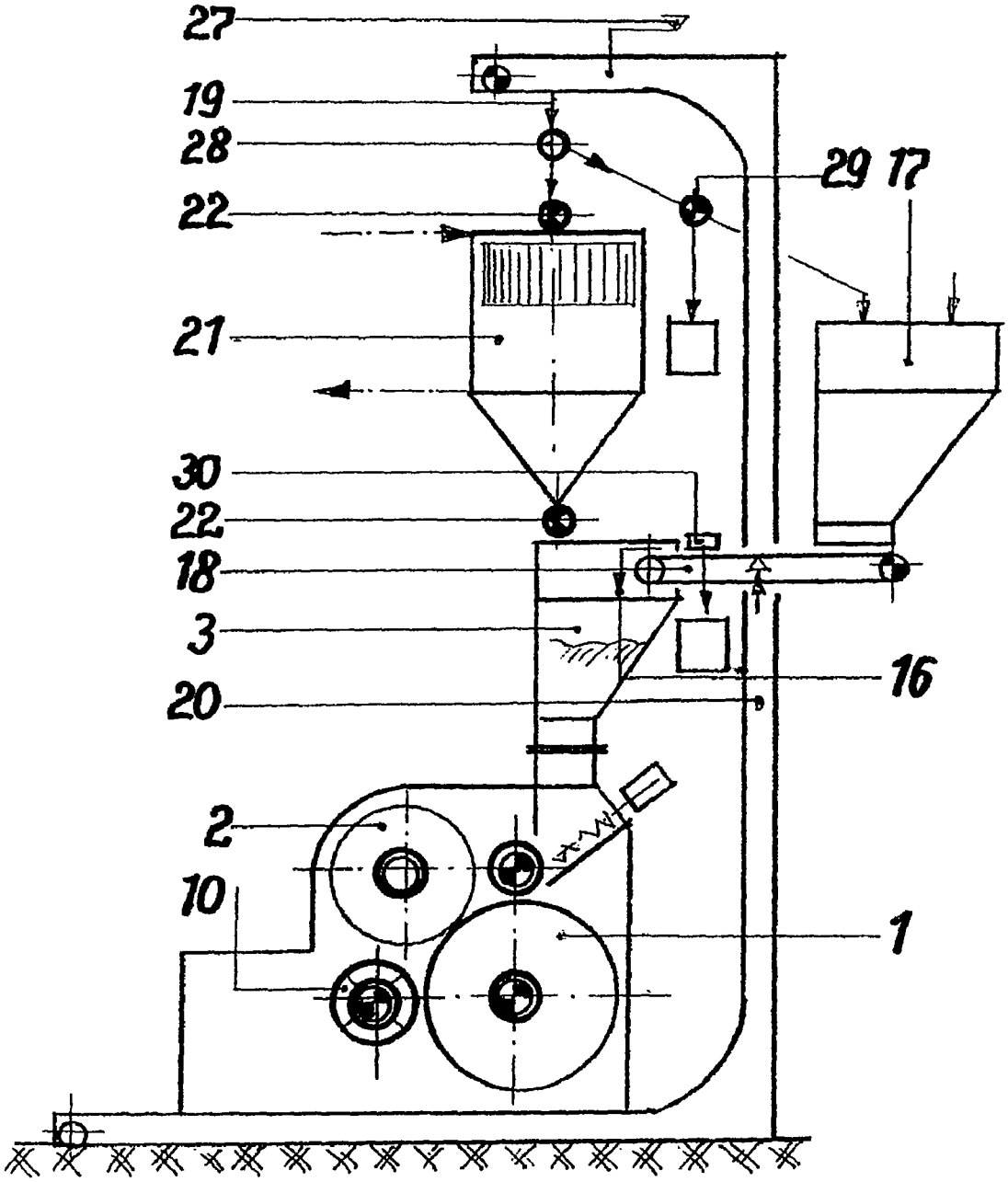
FIG. 4: the apparatus according to the invention connected in a loop with a high-performance separator, specifically for processing dry slag sand.

FIG. 4 shows the flowsheet of a looped grinding installation, as could be used for instance to grind dried slag sands. In this variant, the fresh product 16 is fed by means of a dosing belt weigher 18 directly into the material feed container 3 of the beta roller mill. A two-way chute 28 is located in the material path from the bucket conveyor 20 to the separator 21, with the result that from time to time the circulating product 19 is diverted via a magnetic drum separator 29, in which concentrated iron inclusions are separated out, directly into the dosing bunker 17 for the fresh product 16. The extraneous iron parts in the fresh product 16 are discharged via a magnetic separator 30 above the dosing belt weigher 18. The delivery of fresh product to the beta roller mill is controlled via the filling level of the material in the material feed container 3. The circulating mass flow 19 is measured analogously to FIG. 3 via a throughput measuring device 27 integrated in the bucket conveyor 20.

Figure 5:
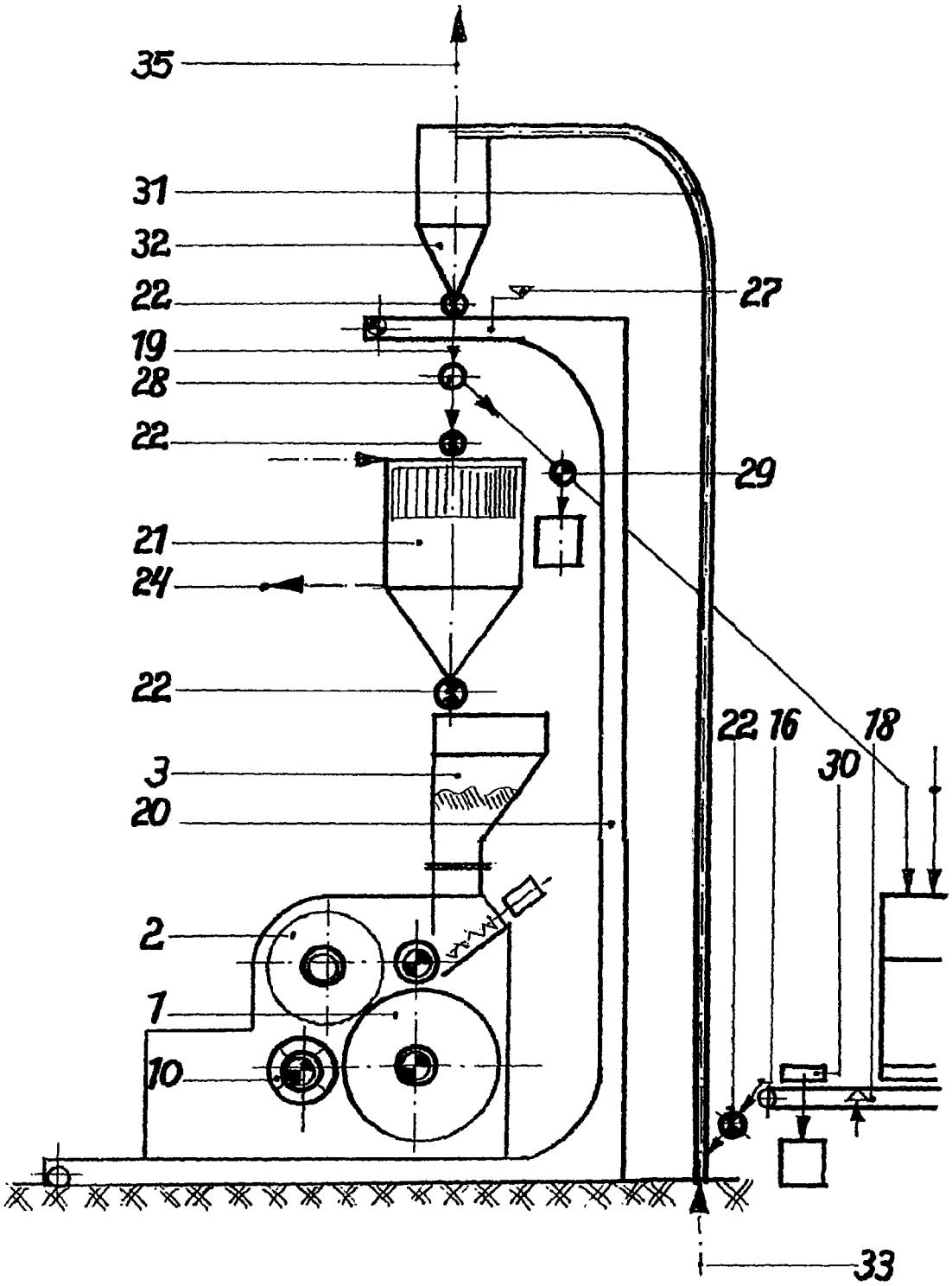
FIG. 5: the apparatus according to the invention connected in a loop with a high-performance separator and upstream riser pipe dryer, specifically for processing moist slag sand.

FIG. 5 shows the flowsheet of FIG. 4, supplemented by a riser pipe dryer 31 and a cyclone separator 32. The drying of fine-grained and pneumatically conveyable materials, such as e.g. moist slag sands, takes place in the riser pipe dryer 31. In the case of this flowsheet variant, the metered moist fresh product 16 is conveyed to the riser pipe dryer 31 subjected to load stress by hot or waste gas 33 via a gas-tight cellular wheel sluice 22 and, after a drying process lasting only a few seconds, the dried slag sand is conveyed to the circulating product 19 at the separator 21 through the cyclone separator 32 which is arranged e.g. above the bucket conveyor 20. The waste gas 35 from the cyclone separator 32 is then either freed from dust directly in the fabric separator provided for removing dust from the separator air, or also advantageously incorporated into the separator air 24, guided in the air loop, of the separator 21.

Figure 6:
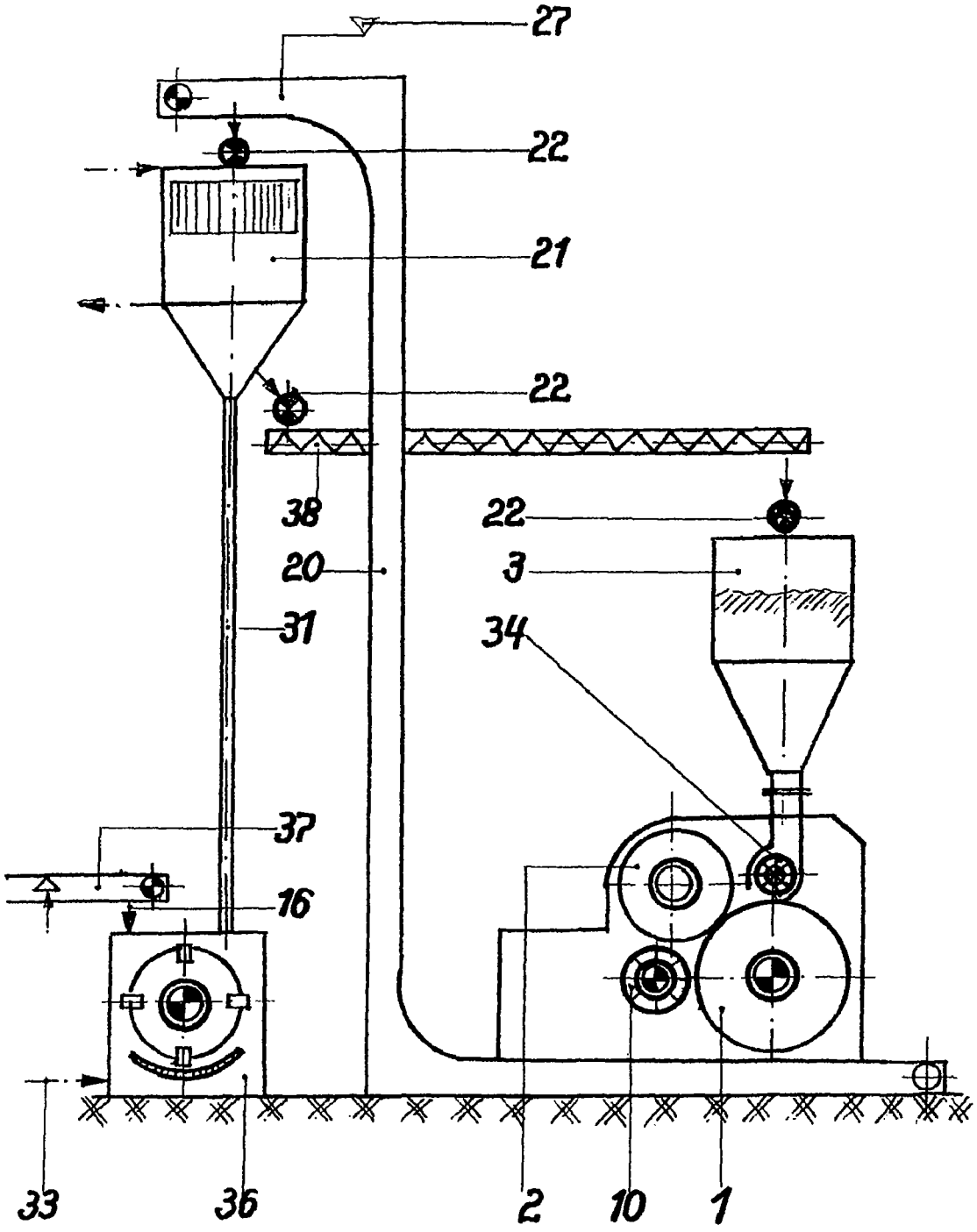
FIG. 6: the apparatus according to the invention combined with a heatable impact hammer mill and a high-performance separator which can be subjected to load stress both pneumatically and mechanically for the coarse comminution and mill drying of moist and lumpy feed product.

FIG. 6 shows the flowsheet of a looped grinding installation with drying and coarse comminution of the fresh product 19 in a heatable impact hammer mill 36. This operates in conjunction with a riser pipe dryer 31 which conveys the preliminarily comminuted and pre-dried feed product pneumatically from below to a separator 21, for example a high-performance separator, while it is subjected to load stress mechanically from above by the circulating product 19 via the bucket conveyor 20. In the case of this installation flowsheet, a Z-shaped bucket conveyor 20 is advantageously used. A worm conveyor 38 transports the grit from the separator 21 to the material feed container 3. The beta roller mill with the material to be comminuted is subjected to load stress via the material feed container 3 and via the variable-speed star wheel feeder 34. The fresh product 16 is conveyed in metered doses to the impact hammer mill 36 via a trough chain conveyor 37.

Figure 7:
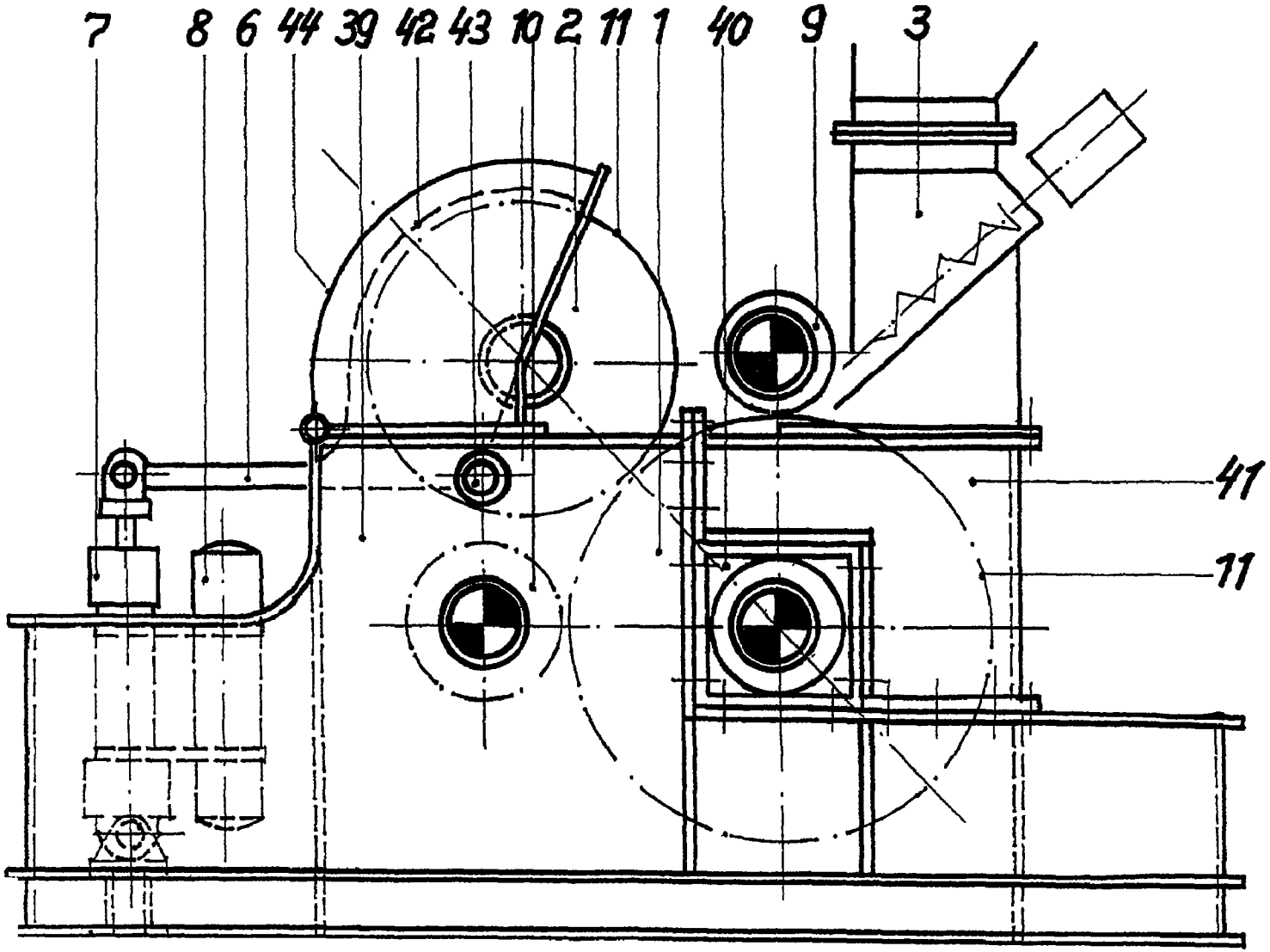
FIG. 7: a side view of the comminution apparatus according to the invention with integrated material feed and discharge apparatus and also a deagglomerator.

FIG. 7 shows, in a simplified structural representation, the apparatus according to the invention with an integrated deagglomerator 10 and material feed container 3 with roll feeder 9 in side view. According to this drawing, the lower, driven roller 1 is housed in an oscillation-stable and machined machine frame 39, consisting essentially of two lateral walls, which can be displaced horizontally by releasing flange joints fully with the square bearing boxes 40 and the end-side casing part 41 for repairs or for the purpose of a deposit welding of the surfaces subjected to load stress 11. The bearings of the deagglomerator 10, the impact circle distance of which from the surface subjected to load stress 11 of the lower roller 1 is adjustable, are preferably also located in the horizontal line of the roller bearings, while the surface subjected to load stress 11 of the upper roller 2 is used at the same time as an impact surface. While the drive roller 1—not represented in more detail in the drawing—is preferably driven via a curved teeth coupling and a straight bevel gear pair which is located together with the variable-speed drive motor on a support structure separate from the machine frame, the likewise variable-speed drive mechanism of the deagglomerator 10 is solidly joined to the machine frame 39. Depending on the requirements, the height of the machine frame 39 can be such that there is also a clearing conveyor, e.g. a worm or scraper conveyor, below the drive roller 1. The upper roller 2 which is hydropneumatically adjusted onto the drive roller 1 and preferably has a smaller diameter than the driven roller 1 is housed horizontally in a bending-resistant housing 42 which is attached to the side walls of the machine framework 39 via a pin support 43 and adjusted onto the material-covered driven roller 1 by one or two hydraulic cylinders 7, depending on the machine size, via a system of levers 6. The hydraulic cylinders 7, advantageously joined to the nitrogen containers 8, are integrated in the machine framework 39 and easily accessible from the end side. The upper roller 2 is covered by a light hood 44 which can be swung open and advantageously leaves free an area as far as the material feed container 3 with roll feeder 9, in order to be able to monitor both the material flow and the layer thickness on the material-covered surface subjected to load stress of roller 1 by direct visual inspection and by installing suitable instrumentation. As can be seen from the drawing, the material feed container 3 with the roll feeder 9 is mounted on the side walls of the machine frame 39.

Figure 8:
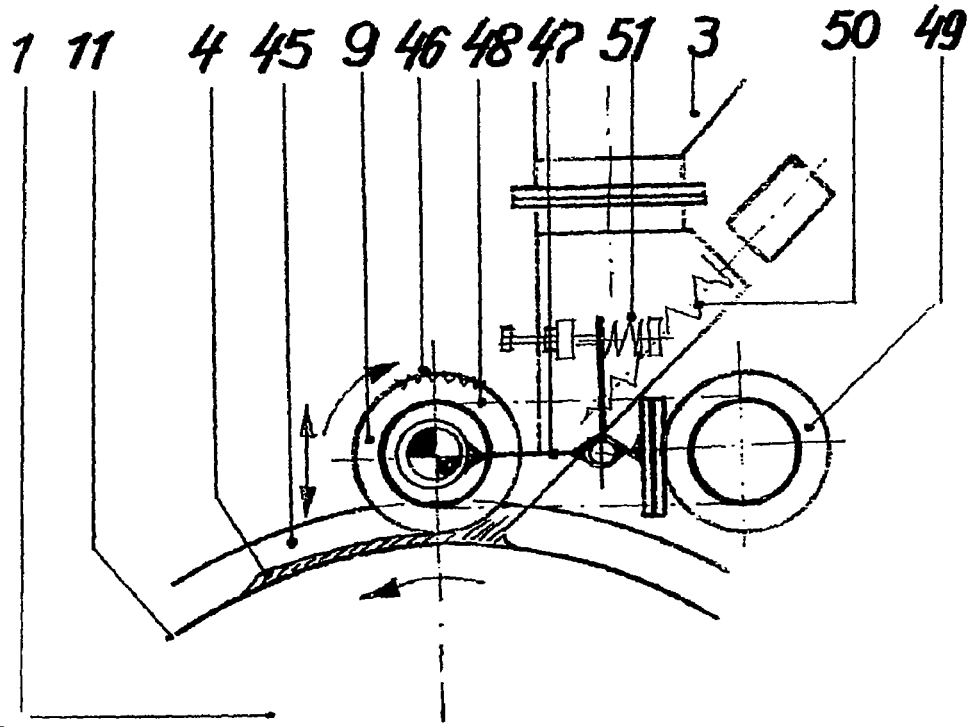
FIG. 8: a variant of the material feed and discharge apparatus according to the invention with a roll feeder.

FIG. 8 shows a variant of the material feed and discharge apparatus according to the invention. The material flows from a filling level-controlled material feed container 3 in the vertex of the lower, driven roller 1 onto the surface subjected to load stress 11 bordered with laterally screwed-on rims 45 and is accelerated by a roll feeder 9 to the circumferential speed of the driven roller 1, prepared as a laterally bordered material layer 4 with predetermined thickness, compressed slightly and transported, surface-smoothed, into the roller or load gap 5 formed from the upper roller 2 and the lower roller 1. The variable-speed roll feeder 9, the running surface 46 of which is preferably structured by a toothing or a deposition welding, rests on a rocker 47 which is housed against the rear wall of the material feed container 3 and via the change in incline of which the desired feed layer thickness 4, e.g. 25 to 30 mm in the case of a slag sand and 45 to 50 mm in the case of a drying oven clinker, can be accurately set to the nearest millimeter. Moreover, the oscillating bearing is designed such that the roll feeder 9 can instantly enlarge the set layer thickness against an adjustable spring system 51, should there be e.g. a particle with over-sized border lengths or a foreign body in the material feed. The roller feeder 9 is driven via a chain or toothed belt drive 48 by a geared motor 49 which is arranged on the other end of the rocker 47. During the handling of grinding products with poor flow behaviour and a special tendency to form crusts, one or more clearing screws 50, depending on the size of the installation, arranged side by side over the inclined wall surface of the material feed container 3 can also be used. The material feed container 3 is subjected to load stress, depending on the operation of the beta roller mill as a coarse or fine mill and depending on the feed point of the fresh product 19, by a dosing belt weigher 18, by a cellular wheel sluice 22 or by the combined use of both pieces of equipment. The residence time of the material in the feed container 3 is in the lower minutes or higher seconds range, whereby it is to be ensured that the material content is always in motion and the roll feeder 9 can prepare the material layer 4 needed for the material feed or loading process with predetermined layer thickness in a speed-proportional manner through an adequate supply of material.

Figure 9:
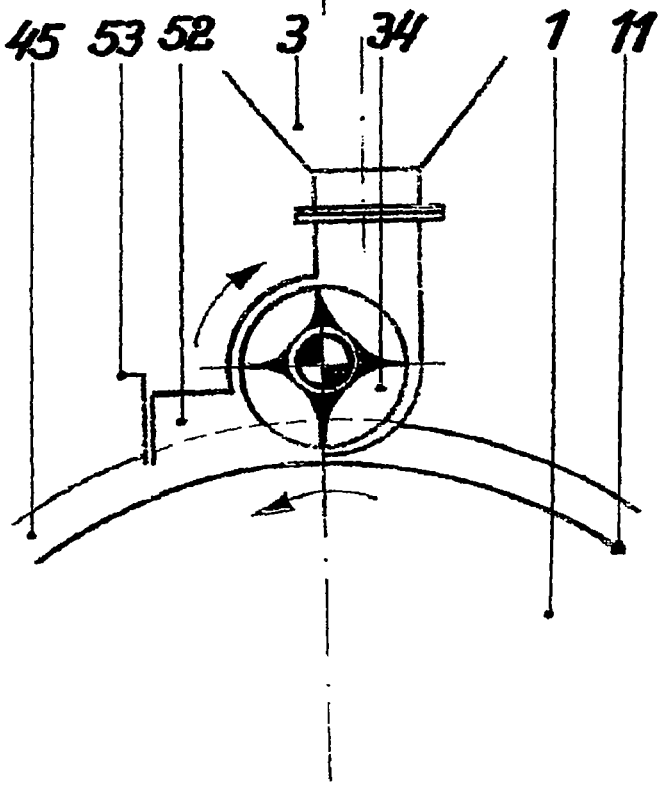
FIG. 9: a variant of the material feed and discharge apparatus according to the invention with a star wheel feeder

FIG. 9 shows a further variant of the material feed and discharge apparatus according to the invention, in the case of which a variable-speed star wheel feeder 34 is used as discharge element. As material buffer, a small pre-bunker 52 which is provided with a flexible layer thickness adjuster 53 is connected upstream of the star wheel feeder 34 on its discharge side. Unlike the variant according to FIG. 8, the use of the star wheel feeder 34 also as discharge element on a feed container 3 with a larger capacity is suitable. The star wheel feeder is advantageously driven directly.

Figure 10:
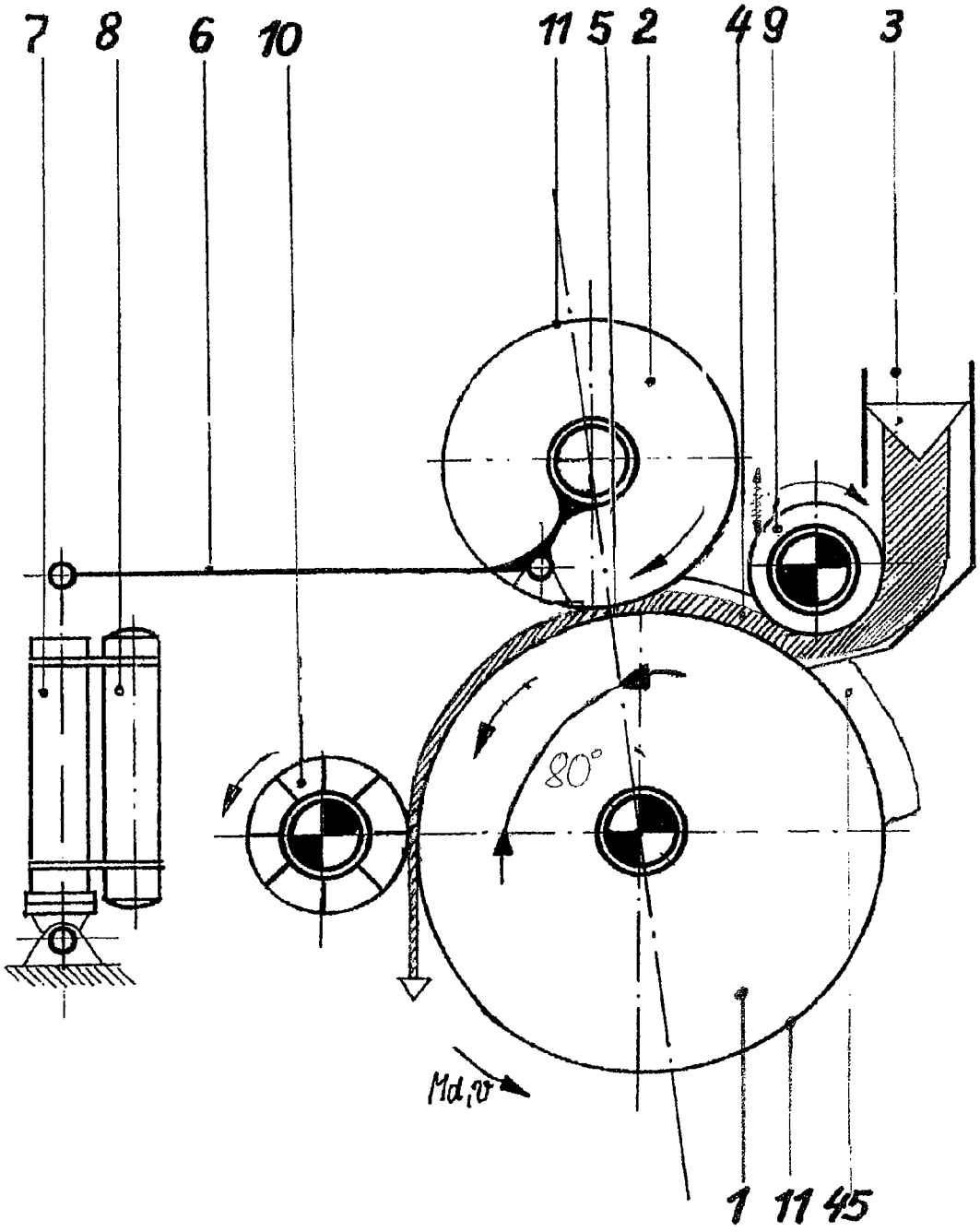
FIG. 10: the apparatus according to the invention in a schematic representation, wherein the upper roller is offset by approximately 80 degrees to the horizontal against the direction of rotation of the lower roller.

FIG. 10 shows a preferred embodiment of the invention. Unlike the embodiment which is represented in FIG. 1, here the upper roller is offset by an angle of approximately 80 degrees to the horizontal against the direction of rotation of the lower roller. The delivery-side end of the feed device is arranged not directly over, but in the direction of rotation of the lower roller a little in front of the vertex of the lower roller. In other respects the structure of this embodiment substantially corresponds to the comminution apparatus described in FIG. 1. Because both the feed device and the roll gap are in the area of the vertex of the lower roller, the direction of conveyance of the grinding product from the feed device as far as the roll gap is substantially horizontal. An additional vertical acceleration of the grinding product at the periphery of the lower roller is thereby avoided. In this way, the homogeneity and a uniform layer thickness of the grinding product can be ensured.

LIST OF REFERENCE NUMBERS

1 driven lower roller
2 upper roller
3 material feed container
4 material layer
5 roller gap
6 system of levers
7 hydraulic cylinder
8 nitrogen container
9 roll feeder
10 deagglomerator
11 surface subjected to load stress
12 vertical roller mill
13 high-pressure roller mill
14 belt roller mill
15 beta roller mill
16 fresh product
17 dosing bunker
18 dosing belt weigher
19 circulating product
20 bucket conveyor
21 separator
22 cellular wheel sluice
23 separating chamber
24 separator air
25 quantity of separator air
26 separator basket
27 throughput measuring device
28 two-way chute
30 magnet separator
31 riser pipe dryer
32 cyclone separator
33 hot gas (waste gas)
34 star wheel feeder
35 waste gas
36 impact hammer mill
37 trough chain feeder
38 worm conveyor
39 machine frame
40 bearing box
41 casing part
42 housing
43 pin support
44 hood
45 rim
46 running surface
47 rocker
48 chain or toothed belt drive
49 geared motor
50 clearing screw
51 spring system
52 pre-bunker
53 layer thickness adjuster

The invention claimed is:

1. A comminution apparatus for the coarse and fine grinding of mineral and non-mineral materials comprising:

a lower, driven roller and an upper roller which are housed horizontally, arranged one above the other and offset relative to each other and form a roller gap, wherein the lower roller is driven at a speed of a grinding path; and a feed device which feeds the material onto the lower roller with a speed component in the direction of rotation of the lower roller;

wherein the speed of the grinding path is 3 to 5% higher than the feed speed of the fed material, and wherein an adjustable quantity of grinding material is fed by the feed device in an area of a vertex of the lower roller and is conveyed to the roller gap as laterally bordered and surface-smoothed layer, which is adjustable in its thickness.

2. The apparatus according to claim 1, wherein the upper, offset roller has a drive mechanism of its own and the line connecting the centres of the two rollers forms an angle of 60 to 90 degrees to the horizontal.

3. The apparatus according to claim 1, wherein to generate the grinding force the upper roller is connected to at least one hydraulic cylinder via a system of levers.

4. The apparatus according to claim 1, wherein a material feed and discharge apparatus arranged in the area of the vertex above the roller comprises a filling level-controlled material feed container with the feed device attached to the material outlet, and wherein the feed device is a rotating feed device.

5. The apparatus according to claim 4, wherein the rotating feed device comprises a roll feeder attached to the material outlet.

6. The apparatus according to claim 1, wherein the driven lower roller is housed in bearing boxes and arranged horizontally displaceable together with the end-side casing part.

7. The apparatus according to claim 1, wherein the roll feeder is housed spring-loaded in a height-adjustable rocker to adjust the layer thickness of the material layer.

8. The apparatus according to claim 1, wherein a star wheel feeder, the rotational speed of which can be adjusted continuously and to the material outlet side of which a pre-bunker with a layer thickness adjuster is attached, is connected downstream of the material feed container.

9. The apparatus according to claim 1, wherein to avoid caking and clogging one or more cantilevered clearing screws are arranged side by side above the inclined discharge wall of the material feed container combined with a roll feeder of the feed device.

10. The apparatus according to claim 1, wherein said mineral and non-mineral materials comprise hard and brittle materials and include one or more of limestone, cement clinker, slag sand, old concrete and ashes.

* * * * *